US006277795B1

(12) United States Patent
Bergman et al.

(10) Patent No.: US 6,277,795 B1
(45) Date of Patent: Aug. 21, 2001

(54) METAL WIRE OR A METAL STRIP HAVING A LUBRICATING SURFACE LAYER, AND A METHOD FOR ITS PREPARATION

(75) Inventors: Magnus Bergman; Bo Jönsson, both of Västerås (SE)

(73) Assignee: Kanthal AB, Hallstahammar (SE)

( * ) Notice: Subject to any disclaimer, the term of this patent is extended or adjusted under 35 U.S.C. 154(b) by 0 days.

(21) Appl. No.: 09/254,208

(22) PCT Filed: Aug. 27, 1997

(86) PCT No.: PCT/SE97/01420

§ 371 Date: May 3, 1999

§ 102(e) Date: May 3, 1999

(87) PCT Pub. No.: WO98/10879

PCT Pub. Date: Mar. 19, 1998

(30) Foreign Application Priority Data

Sep. 10, 1996 (SE) ..... 9603290

(51) Int. Cl.[7] ..... C10M 129/92; B21C 9/02
(52) U.S. Cl. ..... 508/459; 72/42
(58) Field of Search ..... 508/459; 72/42

(56) References Cited

U.S. PATENT DOCUMENTS

| | | | | |
|---|---|---|---|---|
| 2,074,224 | | 3/1937 | Johnson . | |
| 3,098,294 | | 7/1963 | Shapiro . | |
| 4,255,303 | * | 3/1981 | Keogh | 428/379 |
| 4,844,991 | * | 7/1989 | Miura et al. | 428/694 |
| 5,149,451 | * | 9/1992 | Tull | 508/158 |

FOREIGN PATENT DOCUMENTS

| | | | |
|---|---|---|---|
| 908775 | | 4/1954 | (DE) . |
| 2106547 | * | 4/1983 | (GB) . |
| 477187 | * | 10/1976 | (RU) . |

* cited by examiner

*Primary Examiner*—Jacqueline V. Howard
(74) *Attorney, Agent, or Firm*—Birch, Stewart, Kolasch & Birch, LLP

(57) ABSTRACT

A metal wire or a metal strip having a lubricating surface layer is disclosed wherein the surface layer comprises a mixture of a fatty acid having 10–22 carbon atoms and an alkali metal soap of said fatty acid. Furthermore a method of preparing such a wire or strip is disclosed wherein the wire/strip is contacted with a mixture of fatty acid and alkali metal soap according to the above to the formation of the surface layer containing the mixture on the surface of the wire/strip, which surface layer is allowed or caused to dry. The invention also relates to the use of a mixture of fatty acid and an alkali metal soap according to the above for coating as a lubricating surface layer on metal wires or metal strips.

17 Claims, No Drawings

METAL WIRE OR A METAL STRIP HAVING A LUBRICATING SURFACE LAYER, AND A METHOD FOR ITS PREPARATION

This application is the national phase under 35 U.S.C. §371 of prior PCT International Application No. PCT/SE97/01420 which has an International filing date of Aug. 27, 1997 which designated the United States of America.

BACKGROUND OF THE INVENTION

The present invention relates to a metal wire or a metal strip having a lubricating surface layer, a method for its preparation as well as a new use of a mixture of a fatty acid and its alkali metal soap.

Drawn wire or drawn strip is generally subjected to a mechanical processing after the drawing. Such processing calls for low friction. This problem is often solved by the addition of lubricants such as mineral or synthetic oils and cutting fluids during the processing.

However it is desirable to coat the wire/strip with a lubricating surface layer already in the delivery state, i.e. immediately after drawing (and possibly annealing), in order to facilitate the handling. Some methods therefore are already in use. One such method is the coating with a wax layer where the wax is mixed with a solvent, e.g., petrol. Another method comprises coating with silicones which like-wise is carried out by means of solvents. The problem caused by these methods relates to the working environment due to the handling of solvents during coating. Another disadvantage is that the wax must be washed away before the use of the wire/strip detergents such as trichloroethylene or alkaline detergents (generally in combination with ultrasonic treatment) is required. Due to the general desire to keep away from the use of organic solvents and compounds containing chlorine, it is thus desirable for the application of a lubricating surface layer on metal wire and metal strips to be able to use a water-soluble system having minimal influence upon the environment both during the application of the layer and its possible removal before the use of the wire/strip.

A further disadvantage of a lubricating surface layer of wax is the difficulty to achieve complete covering and an even thickness of the layer.

The manufacture of coils puts high demands on lubricating in order to give a uniform pitch and diameter as well as to avoid rips and in addition to give high productivity. For that reason the manufacturer of coils often uses different types of lubricants during the winding of the spiral in spite of the wax layer. However this should be avoided because, for instance, commercial lubricants based on mineral oil often contain aggressive additives which can be difficult to wash away. During use, the remaining residues of lubricant or additives attack the material of the wire and damage the wire in different ways.

A special case within the field of coil manufacturing is the use of resistance alloys, e.g. iron-chromium-aluminium, nickel-chromium(-iron) and copper-nickel, for the manufacture of heating coils for electrical elements. In this case extra high demands are put on uniform coils, high productivity and lenient treatment of the wire surface. Moreover high demands are put on the properties of the lubricant relating to chemical compatibility with the wire material before the use at transport and storing on one hand, and during the use on the other if the lubricant fully or partly remains on the surface.

It is known from U.S. Pat. No. 3,098,294 to coat a draw piece with a sodium soap of a fatty acid as lubricant in cold drawing a small article (specifically a cartridge case) from a draw piece made of brass or mild steel. Among the soaps investigated sodium behenate was found to give the best results whereas sodium laurate and sodium oleate gave the poorest results as regards the force required in the cold drawing which force in case of the two last mentioned soaps becomes higher than that of a comparative mixture of several fatty acid soaps.

SUMMARY OF THE INVENTION

According to the present invention it has now surprisingly been found that the surface layer of a mixture of a fatty acid and an alkali metal soap of the fatty acid gives a substantially better effect as regards the lubricating characteristics and load carrying capacity than a layer of the pure alkali metal soap of the fatty acid and moreover leads to the removal of the disadvantages described above in connection with previously known surface layers for drawn wire or drawn ribbons.

In accordance therewith the invention according to an aspect thereof relates to a metal wire or a metal strip having a lubricating surface layer which wire or which strip is characterized in that the surface layer consists of a mixture of a fatty acid having 10–22, preferably 10–18, carbon atoms and an alkali metal soap of said fatty acid.

DETAILED DESCRIPTION

The terms "alkali metal" and "alkali" is intended in connection with the present invention to relate to sodium and potassium in the first place. The most preferred metal of these is sodium.

The fatty acid is preferably a straight saturated fatty acid but also unsaturated fatty acids such as oleic acid has appeared to give an acceptable effect. The most preferred combination of fatty acid and soap according to the invention is a mixture of lauric acid and sodium laurate.

The invention is advantageously applied to a wire or a strip which constitutes an electric resistance wire or an electric resistance strip, respectively. Such a wire and such a strip, respectively, can for instance consist of a Fe—Cr—Al, Cu—Ni, or Ni—Cr—Fe alloy and can be intended, for instance, for the manufacture of tubular elements or heating coils or electrical elements that can be processed for instance by spiral winding, cutting, punching or bending or another plastic deformation process.

According to another aspect of the invention the invention, relates to a method of preparing a metal wire or a metal strip having a lubricating surface layer, which method is characterized in contacting the wire/strip, preferably after cleaning, with a mixture of a fatty acid having 10–22, preferably 10–18, carbon atoms and an alkali metal soap of said fatty acid dissolved in water to the formation of a surface layer comprising the mixture on the surface of the wire/strip, which surface layer is allowed or caused to dry.

According to a preferred embodiment of the invention, the mixture of fatty acid and soap dissolved in water is one which has been prepared by dispersing the fatty acid in water and then adding an alkali metal hydroxide until no undissolved acid remains, but not all acid has been converted into soap.

The alkali metal hydroxide can be added in the form of a solid or as an aqueous solution which preferably is highly concentrated.

A suitable amount of alkali metal hydroxide added can easily be determined by means of pH measurement. Thus good results are generally obtained if the addition of alkali metal hydroxide is performed to a pH of the mixture of 6–9, preferably 7–8.

Higher fatty acids as well as soaps are surface active substances and form aggregates in solutions. The fatty acids are hydrofobic and form reversed miscelles when being dissolved in oil. The soaps are hydrophilic surface active substances which form normal miscelles in water. What type of aggregates which are formed by a surface active substance can be predicted by considering the balance between hydrophilic and hydrophobic moities of the molecule (HLB="Hydrophile Lipophile Balance"). This is summarized in a Chritical Packing Parameter (CPP). [For further details, see for instance J Israelachvili, Coll Surf A, 91 (1994) 1–8.]

Starting from the fatty acid an increase in the pH-value gives a gradual conversion of the fatty acid to soap. During this conversion, the CPP-value of the mixture will move from about ⅓ to 3. The structure is changed from a micellar one at the CPP-value of about ⅓ via a hexagonal structure, then a cubic, a lamellar, a reversed cubic, and a reversed hexagonal structure to a reversed micellar structure. The lamellar phase is formed at a CPP-value of about 1 corresponding to a pH-value of about 7–8 and a HLB-value of about 10. In the lamellar phase layers of surface active substances are arranged in flakes which easily are sliding against each other and give a low friction. According to the present invention, this condition is the one to be aimed at to the highest possible extent even if certain diversions from the ideal condition may be accepted.

In accordance with this approach, the addition of alkali metal hydroxide can be performed to a critical packing parameter, CPP, of the mixture within the range of 0.75–2, preferably 0.9–1.5.

Prior to the coating of the wire or the strip with the lubricating surface layer, the wire or strip is preferably cleaned in order to remove a possible protecting oil layer or dirt. To this end suitably a mild alkaline aqueous washing liquid is used whereafter rinsing with water or alternatively wiping is carried out. However, the cleaning step may be omitted if the incoming wire/strip complies with certain requirements for purity.

The lubricating layer is suitably applied by immersing the wire/strip into or passing it through a bath of the aqueous mixture of acid and soap. In a continuous process this may be performed by guiding the wire/strip around a number of breaking elements such as rotating pullies. With such a construction also wires/strips travelling in high speeds such as between 10 and 100 m/minute can be coated on-line. At extremely high speeds a subsequent drying step may be necessary, especially for wire which easily rusts, but normally no subsequent treatment is necessary.

Alternative ways of contacting the wire/strip with the aqueous solution of fatty acid and soap is to spray the solution onto the strip/wire or to apply said solution by applying means such as a rag, sponge or brush moistured with the solution.

When being applied, the solution must have a sufficiently high temperature to avoid precipitations. The lower limit of the temperature will vary depending on the acid used. On the other hand the boiling temperature of water sets a natural upper limit of 100° C. for the temperature. Furthermore, from an energy and stability point of view it is important to keep a low application temperature. In the light of these facts the aqueous solution of fatty acid and alkali metal soap usually will have a temperature within the range of 40–95° C. at the application. Preferably the temperature is within the range of 45–70° C. and especially 50–65° C. at the contact of the solution with the wire/strip.

The content of fatty acid/soap in the bath calculated as g fatty acid per 100 g water varies with the system used and its temperature. The lower limit is set by the requirement of sufficient amount of acid/soap on the surface of the wire/strip in order to achieve a sufficient thickness of the lubricating surface layer after drying. The upper limit is set by the solubility and economic considerations. A suitable content of acid/soap for each system of acid/soap can easily be tested by means of some simple experiments with varying contents. Generally the content will be within the range of 0.1–0.5 g/100 g water, preferably 0.15–0.4 g/100 g water and especially 0.2–35 g/100 g water.

According to a further aspect of the invention the invention also relates to the use of a mixture of a fatty acid having 10–22, preferably 10–18, carbon atoms and an alkali metal soap of said fatty acid for coating as a lubricating surface layer on metal wire or metal strip.

Although in the foregoing reference has been made to "a fatty acid" and "an alkali metal soap" it should be obvious to the man of ordinary skill in the art that it is also contemplated to be able to use systems based on two or more fatty acids provided that these together with their soaps are compatible and give a more or less lamellar structure as is aimed at in accordance with the invention without deviating from the present inventive idea.

The invention will in the following be further illustrated by means of a number of examples which in no way should be construed as limiting the invention.

EXAMPLE 1

A bath was prepared by dissolving 20 g of lauric acid and 4 of NaOH in 300 ml of distilled water while heating. The solution was cooled and diluted to 10: 1 with distilled water. This gives a pH-value of 7–8 (CPP-value about 1).

EXAMPLE 2

Example 1 was repeated but the lauric acid was replaced by the corresponding amount of oleic acid.

EXAMPLE 3

Example 1 was repeated but NaOH was replaced by the corresponding amount of KOH.

EXAMPLE 4

Example 2 was repeated but NaOH was replaced with the corresponding amount of KOH.

Comparative Example 1

Procedure as in Example 1 but the addition of NaOH was performed to a CPP-value of >3.

Comparative Example 2

Procedure as in Example 2 but the addition of NaOH was performed to a CPP-value of >3.

Comparative Example 3

Procedure as in Example 3 but the addition of KOH was performed to a CPP-value of >3.

Comparative Example 4

Procedure as in Example 4 but the addition of KOH was performed to a CPP-value of >3.

Examination of Lubricating Characteristics and Load-carrying Capacity

The lubricating characteristics and the load-carrying capacity of lubricating surface layers obtained from baths prepared according to Examples 1–4 were compared with surface layers obtained from baths prepared according to the Comparative Examples 1–4 ("Comp. ex. 1–4"), using a conventional surface layer of a wax and a non-coated surface in an equipment with rotating plate and a stationary ball bearing ball resting against the plate (so called "pin-plate" test).

The principle is as follows: A spherical ball bearing ball having a diameter of 10 mm is pressed with continuously increasing load (maximum load ~24 N) against the (coated or non-coated) plate rotating at a constant speed. The normal load ($F_N$) as well as the force parallel to chord ($F_T$) are measured with high accuracy (~0.01 N) during the process. At some critical load ($F_K$), which depends on the mechanical properties of the coating of the plate (load-carrying capacity), breakdown occurs resulting in rapid increase in the force parallell to the chord. This is due to the fact that the ball which initially glides on the lubricating coating at a sufficiently high load breaks through the coating at which a contact metal-metal arises between the ball and the plate. The friction increases greatly during a short time and seizure will occur. The rotation speed was in all experiments 300 rpm which correspondes to ~0.52 m/s relative gliding speed between ball and plate.

The coefficient of friction ($\mu$) is obtained by the ratio of force parallell to chord (=frictional force) and the normal load.

$$\mu = F_T / F_N$$

By plotting the coefficient of friction as a function of the increasing normal load the lubricating capacity as well as the load-carrying capacity of the protective films can be recorded.

In this connection it should be noted that the coefficient of friction is a system parameter and not a material parameter which depends on a plurality of system dependent factors. For that reason absolute values cannot be compared. Only relative comparing assessments can be made.

Before the system to be tested was applied on the steel surface of the plate, the surface was cleaned by a mild alkaline aqueous washing liquid and was then rinsed with water.

The washing liquid was prepared by preparing an aqueous solution containing 10% by weight of potassium pyrophosphate, 5% by weight Berol 535 (tenside from Akzo Nobel AB, Stockholm, Sweden) and 2.5% by weight Berol 563 (tenside from Akzo Nobel AB, Stockholm, Sweden). The solution was diluted 20 times before use.

The test solutions were applied to the plate by dipping and evaporation of the water by self-drying in combination with blowing with air of room temperature.

The results are reported in the following Table 1.

TABLE 1

| Surface layer from | Level of friction before breakdown [$\mu$] | Breakdown load [N] |
|---|---|---|
| No surface layer | not defined | 0.94 |
| Surface layer of wax | 0.30–0.45 | 2.1 |
| Ex 1 | 0.10–0.18 | no breakdown |
| Ex 2 | 0.10–0.20 | 23.2 |
| Ex 3 | 0.09–0.18 | 13.9 |

TABLE 1-continued

| Surface layer from | Level of friction before breakdown [$\mu$] | Breakdown load [N] |
|---|---|---|
| Ex 4 | 0.20–0.24 | 7.1 |
| Comp. Ex. 1 | not defined | 2.9 |
| Comp. Ex. 2 | not defined | 1.1 |
| Comp. Ex. 3 | 0.10–0.18 | 3.2 |
| Comp. Ex. 4 | 0.25–0.40 | 5.6 |

Note: "Not defined" means no or almost non-existent lubricating effect. Low breakdown load or immidate seizure. "Ex" is short for example and "Comp. Ex." is short for comparative example.

The test was repeated but using a plate coated with the mixture according to Example 1 after washing of the coated plate with water on one hand and after wash of the coated plate with a weak alkaline solution on the other hand at 50° C. in both cases.

The results are reported in the following Table 2.

TABLE 2

| Washing | Level of friction before breakdown [$\mu$] | Breakdown load [N] |
|---|---|---|
| Aqueous washing | 0.10–0.29 | no breakdown |
| Alkaline washing | not defined | 0.46 |

This experiment shows that washing with solely water gives some increase in the level of friction in comparison with a coating which is not washed but the coating will still lubricate and no breakdown occurs. Furthermore this experiment shows that the coating simply can be washed away in a washing system based on water.

Testing in the Manufacture of Spirals

A wire of resistance material having a diameter of 0.575 mm was coated with a lubricating surface layer by passing it through a bath according to Example 1 at 50° C. The surface layer was allowed to dry whereafter the wire was spiralized in a conventional way at which tests at different speeds of spiralizing were carried out.

Measurements of the variation in pitch resulted in an average variation of the pitch of 4.7 and 5.3% for normal and maximal speed of spiralizing, respectively, to be compared with 11 and 16%, respectively, for uncoated wire.

Testing of Corrosion in Moist Air

Blank drawn and blank drawn plus with an alkaline degreasing agent based on triethanolamine cleaned metal wires of Fe—Cr—Al alloys containing about 21% Cr and 5% Al (Kanthal AE and Kanthal D from Kanthal AB, Hallstahammar, Sweden) were coated with a lubricating surface layer by passing them through a bath according to Example 1 at 50° C. and subsequent drying.

The wires were exposed to moist air in a humidity chamber during 2 months. The surface was examined with stereomicroscope at which no corrosion attack could be seen. The wires were also heat treated at 1100° C. for 2 h in order to ascertain if the normal formation of oxide had been influenced. The oxide was examined in stereomicroscope and was verified to be quite normal.

Testing of Tubular Elements (Closed Environment)

3 tubular elements each of the following three kinds were manufactured from resistance wire having a diamater of 0.32 mm (N80 från Kanthal AB, Hallstahammar, Sweden):

1. References, spiralized with an alkaline degreasing agent based on triethanolamine (Sellcleaner 1090 from Henkel Kemi AB, Mölndal, Sweden) as lubricating agent, were washed in ultrasound, hot water and distilled water.

2. Non-washed wires coated with a surface layer of a mixture according to Example 1.

3. Non-washed wires coated with a conventional wax layer.

The elements were run 1 h on/20 min off at 8 W/cm$^2$ for 1000 h. Results, leak current after 1000 h:

1: 0.96 mA; 2: 0.68 mA; 3: 0.75 mA.

These values are low and normal for the test.

Testing of Oxidation in Air

Non-washed wire of a Ni—Cr alloy (Nikrothal 80 from Kanthal AB, Hallstahammar, Sweden), diameter 0.575 mm, which had been provided with a surface layer of a mixture from Example 1 in a corresponding way as stated above, and a corresponding reference wire were heat treated at 1050° C. for 3 h. The oxide appeared normal and very good in stereomicroscope.

Testing of Spirals in Air (Heavily-loaded Intermittent Use in Air)

Wires of a Fe—Cr—Al alloy (Kanthal AE from Kanthal AB, Hallstahammar, Sweden), diameter 0.40 mm, were coated with a lubricating surface layer starting from a mixture according to Example 1 in a corresponding way as is stated above after previous cleaning in an alkaline degreasing agent based on triethanolamine (Sellcleaner 1090 from Henkel Kemi AB, Mölndal, Sweden) on one hand and without previous cleaning on the other. Spirals of the coated wires and of the corresponding uncoated wires as references were manufactured with relative pitch of 3 and an outer diameter of 5 mm. These are then heated intermittently with passage of current at 11 W/cm$^2$ (surface temperature about 1050° C.).

The oxidation process proceeded quite normally for all the 3 samples which was established by measuring the change in warm and cold resistance of the samples after a test time of 1200 h as well as by occular inspection.

What is claimed is:

1. A metal wire or a metal strip having a lubricating surface layer, which wire/strip is characterized in that the surface layer consists of a mixture of a fatty acid having 10–22 carbon atoms and an alkali metal soap of said fatty acid.

2. The metal wire or metal strip according to claim 1, wherein the fatty acid is a straight chained saturated fatty acid.

3. The metal wire or metal strip according to claim 1, wherein the fatty acid is lauric acid and the soap is sodium laurate.

4. The metal wire or metal strip according to claim 1, wherein the wire/strip is an electric resistance wire or an electric resistance strip, respectively.

5. A method of preparing a metal wire or a metal strip, the wire/strip having a surface layer consisting of a mixture of a fatty acid having 10–22 carbon atoms and an alkali metal soap of the fatty acid, said method comprising:

contacting the wire/strip with an aqueous mixture of fatty acid having 10–22 carbon atoms and an alkali soap of the fatty acid;

forming a surface layer of the aqueous mixture on wire/strip; and drying the surface layer.

6. The method according to claim 5, wherein the aqueous mixture of fatty acid and soap is prepared by the steps of:

dispersing the fatty acid in water; and adding an alkali metal hydroxide until no undissolved acid remains but not all acid has been transformed to soap.

7. The method according to claim 6, wherein adding the alkali metal hydroxide is carried out to a pH-value of the mixture of 6–10.

8. The method according to claim 6, wherein adding the alkali metal hydroxide is carried out to a critical packing parameter, CPP, of the mixture within the range of 0.75–2.

9. The method according to claim 5, wherein contacting the wire strip is performed at a temperature of 40–95° C.

10. The metal wire or metal strip according to claim 1, wherein the fatty acid has 10–18 carbon atoms.

11. The method according to claim 5, wherein the fatty acid has 10–18 carbon atoms.

12. The method according to claim 6, wherein adding the alkali metal hydroxide is carried out to a pH-value of the mixture of 7–8.

13. The method according to claim 5, wherein contacting the wire strip is performed at a temperature of 45–70° C.

14. The method according to claim 5, wherein contacting the wire strip is performed at a temperature of 45–65° C.

15. The method according to claim 6, wherein adding the alkali metal hydroxide is carried out to a critical packing parameter, CPP, of the mixture within the range of 0.9–1.5.

16. The method according to claim 6, wherein adding the alkali metal hydroxide is carried out to a critical packing parameter, CPP, of the mixture within the range of 0.9–1.2.

17. The metal wire or metal strip according to claim 1, wherein the surface layer has a lamellar phase.

* * * * *